United States Patent [19]

Engelmohr

[11] 4,450,706

[45] May 29, 1984

[54] METHOD AND APPARATUS FOR FORMING COLLIMATOR STRIPS

[75] Inventor: Gustav O. Engelmohr, Glenview, Ill.

[73] Assignee: Siemens Gammasonics, Inc., Des Plaines, Ill.

[21] Appl. No.: 346,917

[22] Filed: Feb. 8, 1982

[51] Int. Cl.[3] ..... B21D 13/02

[52] U.S. Cl. ..... 72/385; 72/475; 378/149

[58] Field of Search ..... 72/385, 380, 412, 474, 72/414, 475; 378/149

[56] References Cited

U.S. PATENT DOCUMENTS

| | | | |
|---|---|---|---|
| 1,546,195 | 7/1925 | Briskin | 72/450 |
| 2,499,977 | 3/1950 | Scott | 184/4 |
| 3,213,665 | 10/1965 | Robinson | 72/385 |
| 3,407,300 | 10/1968 | Hansen | 387/149 |
| 3,921,000 | 11/1975 | Muehllehner | 378/149 |
| 3,936,340 | 2/1976 | Muehllehner | 72/196 |
| 3,937,969 | 2/1976 | Muehllehner | 378/149 |
| 3,943,366 | 3/1976 | Platz | 378/149 |
| 4,008,591 | 2/1977 | Vos | 72/385 |
| 4,081,687 | 3/1978 | York | 378/149 |

*Primary Examiner*—Gene P. Crosby

*Attorney, Agent, or Firm*—Karl F. Milde, Jr.; Andrew G. Rodau

[57] ABSTRACT

The apparatus forms a profilated collimator strip out of a band of deformable material. It contains a first and a second forming tool, both of which contain a row of forming teeth. The teeth may be hexagonal to form corresponding deformations having sidewalls greater in width than the top or bottom walls. In operation, the teeth are disposed oppositely and staggered with respect to each other. The apparatus also contains a device for performing a relative movement between the two tools, whereby the tools approach each other. The apparatus also includes a device for moving one of the tools parallel to the other one in an indexing step by step motion. In the method for forming a profilated collimator strip, a band is placed on one tool, whereby a portion of the band is located in the space between the two tools which are positioned oppositely to each other. Then the tools are approached to each other, the teeth thereby pressing the band into the predetermined shape. When the tools are subsequently retracted from each other, one tool is moved in a step motion parallel to the other tool. Thereby, an additional portion of the band is introduced into the space to be formed.

12 Claims, 9 Drawing Figures

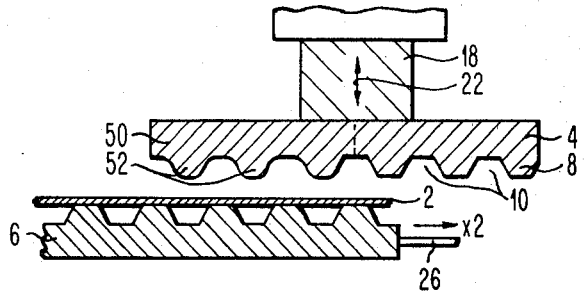
FIG. 5
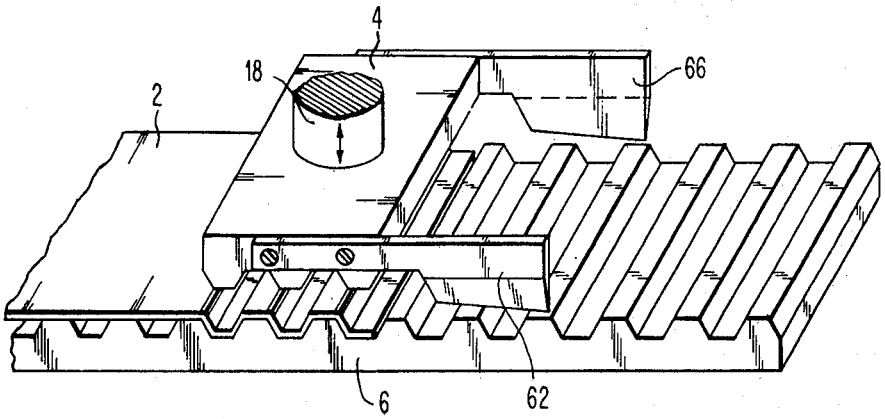
FIG. 6
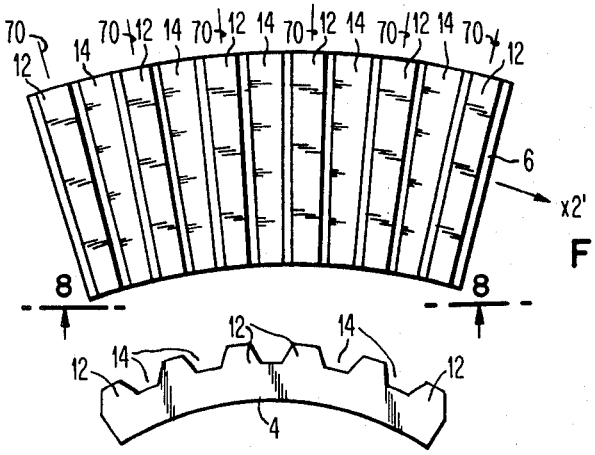
FIG. 7
FIG. 8
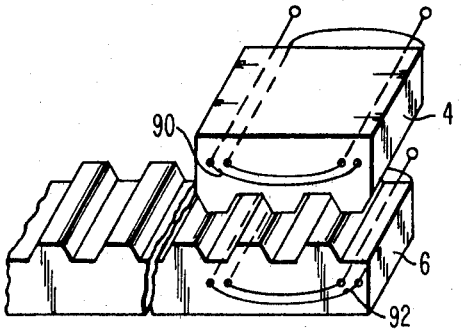
FIG. 9

METHOD AND APPARATUS FOR FORMING COLLIMATOR STRIPS

CROSS REFERENCE TO RELATED APPLICATION

This invention relates to the same technical field as the commonly owned application of William R. Guth and Gustav O. Engelmohr entitled "Apparatus for Forming Collimator Strips for Focused Collimator", U.S. Ser. No. 346,916, filed on the same date as this application.

BACKGROUND OF THE INVENTION

1. Field of the Invention

This invention relates to a novel and improved method and apparatus for forming collimator strips under pressure. In particular, this invention relates to a method and an apparatus for forming collimator strips which can be assembled to form a collimator having hexagonal radiation transmitting channels. Still more particularly, this invention relates to a method and an apparatus for forming collimator strips for a collimator having hexagonal holes of equal thickness. Such collimators may be used in diagnosing apparatuses that take images produced by gamma rays, X-rays, or similar penetrating rays.

2. Description of the Prior Art

Collimators consisting of a honeycomb-like constructed body with many channels for transmitting penetrative radiation therethrough are widely used in the medical field. Such collimators for penetrative radiation are used during radiation diagnosis to shape the beam coming from a patient to be examined. They are commonly used in connection with gamma radiation, X-rays and other penetrative radiation.

Efforts have been made to design collimators having channels with hexagonal cross sections. In particular, collimators incorporating hexagonal channels which have all the same wall thickness are of primary interest. In the past, efforts have been made to fabricate such collimators which provide the desired hexagonal channel form with great precision. One solution to meet this goal is disclosed in U.S. Pat. No. 2,499,977. This method requires a large number of steps, including dissolving a core metal by a chemical reagent. Therefore, this method is relatively expensive. Another solution is disclosed in U.S. Pat. No. 3,407,300. This method includes wrapping radiation-absorbing foils around a large number of mandrels. Therefore, this method also requires a considerable amount of work.

U.S. Pat. No. 3,943,366 discloses a method for producing a collimator and an apparatus for making collimator strips. The collimator consists of a plurality of strips which extend parallel to each other in a longitudinal direction and which are folded transversely to their longitudinal extension. Thus, each of these strips has a series of uniform and uniformly spaced outwardly extending portions or teeth, and uniform flat portions or excesses between the outwardly extending portions. When the collimator is assembled, the flat portions of two adjacent strips engage each other, whereby the outwardly extending portions of these two adjacent strips extend in opposite directions. The interengaging flat portions are glued together. Thereby, the strips form a series of parallel channels. In particular, a trapezoidal shape is selected. That is, each of the outwardly extending portions consists of a middle part extending parallel to the flat portions, and two inclined parts joining the middle part to adjacent flat portions. Due to this design, hexagonal channels are obtained. The interengaging flat portions preferably are one half of the thickness of the inclined strip portions. This provides for hexagonal channels the six walls of which have all the same wall thickness.

U.S. Pat. No. 3,943,366 also discloses a device for making collimator strips having outwardly extending portions and flat portions inbetween. This device comprises two wheels which have interengaging teeth. These teeth have the shape of the outwardly extending strip portions. During the strip forming process, a flat band of malleable material such as lead is introduced between the interengaging teeth. The band is shaped to assume the desired folded form, whereby the flat portions are pressed to one half of the original thickness.

The contents of U.S. Pat. No. 3,943,366 is incorporated herein by reference.

It has been found that if two forming wheels are used which have equal diameter and the same number of teeth, each tooth of the driving wheel may take in more strip material than is actually needed in the cavity between the tooth and the adjacent recess of the other wheel. This surplus material will be trapped. This may result in collimator strips which have outwardly extending portions that are unevenly formed. This result is particularly undesired in collimator strips which have only small outwardly extending portions. Such collimator strips are used for assembling collimators with small hexagonal channels. Focused collimators for gamma radiation are disclosed, for instance, in U.S. Pat. Nos. 3,921,000, 3,936,340 and 3,937,969.

SUMMARY OF THE INVENTION

1. Objects

It is an object of this invention to produce folded collimator strips which have a regular pitch and shape.

It is another object of this invention to provide a method and apparatus for producing folded collimator strips for a collimator having a large number of channels for passing penetrating rays therethrough, which channels have a predetermined shape and wall thickness.

It is still another object of this invention to provide a method and an apparatus for producing folded collimator strips for a collimator which contains a large number of channels for passing penetrating rays therethrough, whereby the channels have a hexagonal cross section.

It is another object of this invention to provide collimator strips which have folds transverse to a longitudinal strip direction, whereby the folded strips are made out of one piece of material and extend relatively a greater distance in the longitudinal direction.

It is still another object of this invention to provide collimator strips for the collimator of a medical apparatus, whereby the collimator contains a large number of channels and whereby the walls of all of these channels have the same thickness.

It is still another object of this invention to provide folded collimator strips for an X-ray or gamma radiation collimator which has a large number of relatively small channels for passing the X-rays or gamma radiation, respectively, therethrough.

2. Summary

According to this invention, an apparatus for forming profiled strips contains a first forming tool which is provided with a first array of forming teeth and a second forming tool which is provided with a second array of forming teeth. The second teeth are arranged opposite to and staggered with respect to the first teeth. The apparatus also contains a device for performing an indexing relative movement between the first and second tools along a direction parallel to the first and second arrays. The apparatus additionally contains a device for moving the first and second tools towards each other, thereby punching or printing a portion of a strip of deformable material interposed between the first and second teeth into a desired shape.

Accordingly to the invention a method for forming collimator strips of band material that is deformable under pressure contains the steps of positioning a band of this material on a first forming tool containing a first array of teeth, moving a second forming tool preferably linearly towards the first forming tool, which second forming tool contains a second array of teeth, thereby pressing a band portion into the desired shape, disengaging the second forming tool from the band, and performing an indexing movement between the first and the second tools along a direction parallel to the first and second arrays of teeth.

The foregoing and other objects, features and advantages of the invention will be apparent from the following more particular description of preferred embodiments of the invention, as illustrated in the accompanying drawings.

BRIEF DESCRIPTION OF THE DRAWINGS

FIG. 5 is a schematic cross-sectional view of an apparatus similar to FIG. 1, wherein a portion of one forming tool is designed as a preforming tool;

FIG. 6 is a schematic perspective view of an apparatus according to this invention, including shearing blades;

FIG. 7 is a plan view of a forming tool having radially arranged teeth;

FIG. 8 is a curved section through 8—8 of FIG. 7; and

FIG. 9 is a perspective view of an apparatus for forming profiled collimator strips, which apparatus contains two heated forming blocks.

DETAILED DESCRIPTION OF THE PREFERRED EMBODIMENTS

Figure 1:
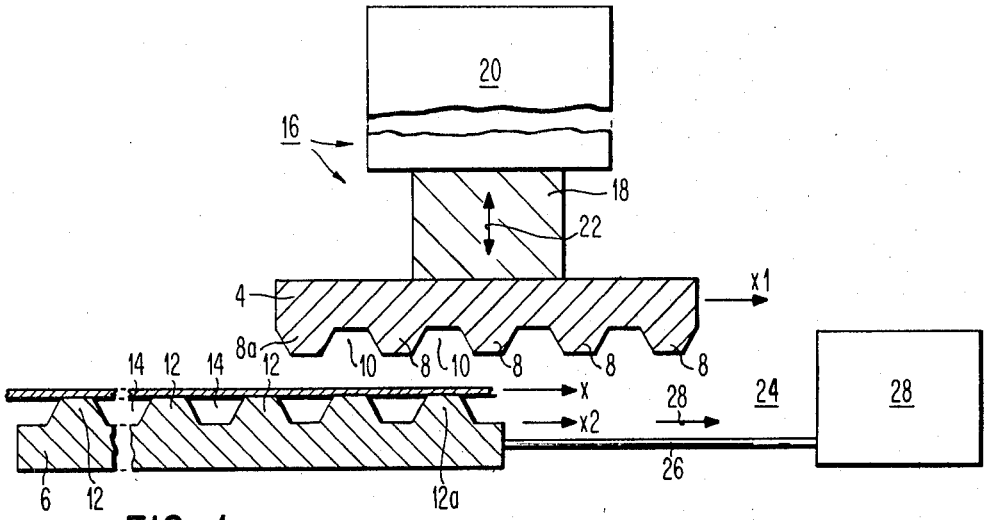
FIG. 1 is a schematic cross-sectional view of an apparatus for forming profiled collimator strips according to this invention.

With reference to FIG. 1, an apparatus for forming a profiled or profilated collimator strip out of a band 2 contains a first forming tool 4 and a second forming tool 6. The band 2 is shown to be a flat strip or sheet. It consists of conventional material opaque with respect to the radiation for which the finalized collimator is determined. This material is deformable under pressure. For X-ray and gamma radiation applications, the band 2 preferably consists of lead.

The first and second forming tool 4 and 6, respectively, are metal blocks. Preferably they are made of a hardened and ground steel or a hard brass. Both forming tools 4 and 6 extend in horizontal directions x1 and x2, respectively, which are parallel to each other. It will be noted, however, that the first forming tool 4 is shorter in length than the second forming tool 6. The tools 4 and 6 also extend perpendicularly to the directions x1 and x2, respectively. Their extensions in these directions determine the width of the finalized collimator strip.

The first forming tool 4 has an upper end face which is plane, and a lower end face which is provided with a certain number or a first row or array of teeth 8 and grooves or recesses 10 along the first linear direction x1. In the illustrated embodiment, an array of five teeth 8 is provided along a horizontal plane. It will be understood, however, that any other number of teeth 8 can be applied. The teeth 8 and recesses 10 extend transversely to the linear direction x1, that is perpendicularly to the paper plane of FIG. 1. Thus, the teeth 8 represent an array of five outwardly extending surface portions which are arranged parallel to each other.

All teeth 8 have the same shape. Correspondingly, all recesses 10 have the same shape. In the illustrated embodiment, the shape of the teeth 8 is the same as the shape of recesses 10. As will be apparent later from FIG. 3, this is not a necessary requirement. In particular, the shape of the teeth 8 and the recesses 10 is shown in FIG. 1 to be trapezoidal. The shape and pitch can freely be selected.

The second forming tool 6 has a plane lower end face and an upper end face which is provided with a plurality or a second linear array of teeth 12 and grooves or recesses 14 transverse to a second linear direction x2. In the illustrated embodiment, an array of more than six teeth 12 extends along a horizontal plane. In operation, the upper end face of the second forming tools 6 is arranged oppositely to the lower end face of the first forming tool 4. The teeth 12 have the same shape as the teeth 8, that is they are trapezoidal. Correspondingly, the recesses 14 have the same shape as the recesses 10, that is they are also trapezoidal. The teeth 12 have the same pitch as the teeth 8, and the recesses 14 have the same pitch as the recesses 10. The second tool 6, taken in the second direction x2, is as long as the finished collimator strip, whereas the first tool 4 is shorter than the finished collimator strip.

It will be noted from FIG. 1, that in the retracted position shown, the teeth 12 are staggered with respect to the teeth 8. In other words, the first tooth **12*a* of the second tool 6 is positioned opposite to a recess 10 provided in the first tool 4**.

The band 2 is supported by the flat end portions of the teeth 12. These teeth 12 and the recesses 14 also extend some distance perpendicularly to the second linear direction x2, that is perpendicularly to the paper plane of FIG. 1. The teeth 12 are arranged parallel to the teeth 8.

The apparatus also contains a device for performing a closing and opening movement between the first forming tool 4 and the second forming tool 6. This device, generally designated by the reference numeral 16, comprises a rod or column 18 firmly attached to the first forming tool 4, and a movable support 20 therefor. This movable support 20 is of any suitable conventional design and may comprise an electric or hydraulic motor. It ensures that the rod 18 along with the first forming tool 4 can be moved vertically, that is in the direction of the double arrow 22. In other words, the moving support 20 moves the first forming tool 4 from the retracted position shown in FIG. 1 vertically downwardly towards the second forming tool 6 which is fixed. When such a closing movement is performed, the teeth 8 will be inserted into the recess 14, thereby pressing and deforming the interposed band 2. When the final forming position is reached, the band 2 has adopted the desired shape, which is the surface shape of the tools 4 and 6. Subsequently, after this coining or printing operation, in an opening movement, the device 20 draws the first forming tool 4 back into the retracted position shown in FIG. 1.

There is also provided a device for performing an indexing step by step movement between the first and the second tool 4 and 6, respectively. This device is generally designated by 24. This device 24 consists of a connecting device 26 such as a rod, a flexible wire or a thread and suitable conventional means 28 connected for the rod 26 for moving this rod 26 longitudinally such as a pulling device. The connecting device 26 is connected to the right end of the second forming tool 6. The moving means 28 is of any suitable design and may comprise an electric stepping motor. The moving means 28 moves the rod or thread 26 in a step by step movement longitudinally, for instance, to the right side as seen in FIG. 1. This is indicated by an arrow 28. Each such step movement is done while the first forming tool 4 is in its retracted position. The second forming tool 6 may be guided by guiding rails (not shown) when sliding on a fixed support (not shown).

The second forming tool 6 may be moved in the direction of the arrow 28 the width of one tooth 12 at a time. In contrast hereto, it may also be moved by two or more teeth 12 at a time. Thus, the second forming tool 6 and thereby the band 2 is transferred from the illustrated first forming position to a second forming position in which an additional portion of the band 2 is exposed to a printing or coining operation by the first forming tool 4.

The actuation of the devices 20 and 28 and/or the synchronization may be preformed by an operator by hand. If electric motors are used, foot actuators are preferred since such a design leaves free the hands of the operator for manipulations during the fabricating process. Actuation and synchronization can also be preformed automatically by means of a control device (not shown) controlling the devices 20, 28.

A method for forming collimator strips in the apparatus illustrated in FIG. 1 is as follows: In a first step the band 2 of deformable material is placed on top of the teeth 12 of the second forming tool 6. The first forming tool 4 is hereby in the retracted position. In a next step, the moving device 28 advances the second forming tool 6 and the band 2 in the direction of the arrow 28 such that at least one tooth 8 or 12 is adjusted to a recess 14 or 10, respectively. In the next step, the movable support 20 pushes the first forming tool 4 downwardly, thereby giving a first portion of the band 2 the desired trapezoidal shape. Subsequently the support 20 retracts the first forming tool 4 from the band 2, until the retracting position is reached again. Now the moving device 28 advances the second forming tool 6 and the band 2 in the direction of the arrow 28 by the width of a single tooth 12, or by the width of another selected number of teeth 12. After this step movement, an additional portion of the band 2 is positioned between the forming tool 4 and 6. Now, the vertical moving device 20 again pushes the first forming tool 4 downwardly towards the second forming tool 6. The additional portion of the band 2 is thus brought into the desired trapezoidal shape, while the trapezoidal form of the previously deformed first portion is maintained. After this printing action the moving device 20 again lifts the first forming tool 4. Subsequently the horizontal moving device 28 advances again the second forming tool 6 and the band 2 therewith by another step.

This procedure is continued until the entire length of the second forming tool 6 has been placed underneath the first forming tool 4 and until the band 2 placed thereon has received the desired forming treatment.

It will be noted that during the forming process only linear movements are carried out. It will also be noted that the forming is basically done by the first teeth 8*a* and 12*a*. The consecutive teeth 8 and 12 are also very important. They retain the shape of the previously formed band portion.

It is considered as one of the advantages of this process that the shape of the teeth 8, 12 and recesses 10, 14 of the tools 4 and 6, respectively, is the final shape of the folded collimator strip. During the forming process, the selected spaced between the teeth 8 and 12 is maintained. Therefore, bands 2 which are relatively long in the longitudinal direction x, can be formed. This avoids the necessity of affixing smaller pieces together, for instance by gluing. It has been found that finished collimator strips as long as 18 inches or even much more can be obtained with the accurate pitch and shape of the teeth and recesses in the tools 4 and 6.

Figure 3:
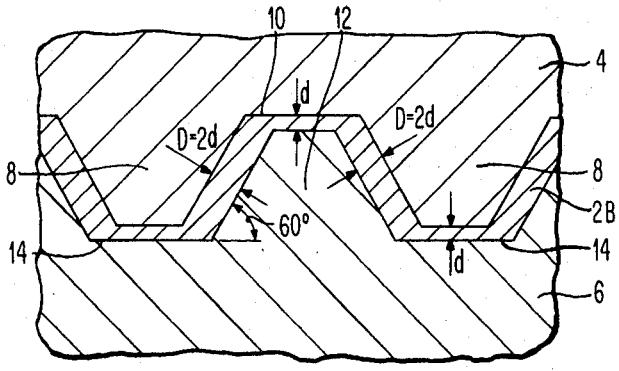
FIG. 3 is a cross-sectional view of complimentary sections of two forming tools in their forming position, thereby forming a collimator strip of a preferred profile, i.e. illustrating relative dimensional differences, according to this invention.

In FIG. 3 is illustrated a modified forming process. FIG. 3 shows a second forming tool 6 with a band 2A placed on the teeth 12 thereof. The band 2A is ready for introduction into the forming process. In this embodiment the band 2A is a strip of deformable material such as lead which is already preformed. In particular, the band 2A has a wave-like shape. The pitch is the same as that of the teeth 12. The application of preformed material makes it easier to perform the actual pressing or printing process and to obtain a high accuracy of the dimensions.

Figure 2:
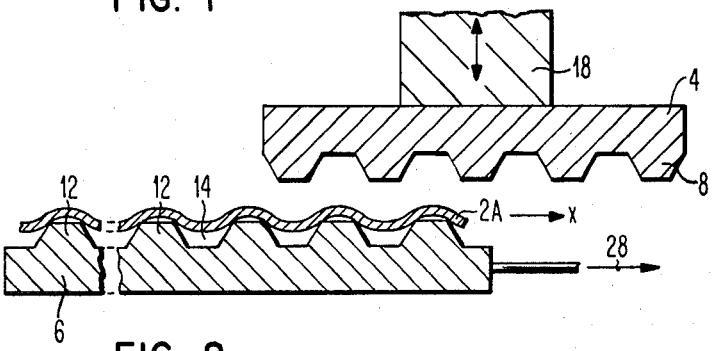
FIG. 2 is a portion of the apparatus illustrated in FIG. 1, whereby a preformed band of deformable material is positioned across a first (lower) row of teeth.

In FIG. 3 a portion of a first forming tool 4 and a portion of a second forming tool 6 are illustrated. The tools 4 and 6 are in the final forming position forming a band 2B. From FIG. 3 can be seen that the deformed band 2B has wall portions of different thickness. This is due to the fact that the distance d between a recess 10 and a tooth 12 as well as between a tooth 8 and a recess 14 is selected to be smaller than the distance D between the side walls of the teeth 8 and the side walls of the teeth 12. In particular, in order to obtain a hexagonal collimator having equal wall thicknesses, the thickness D is chosen to be $D=2d$. It is obvious from FIGS. 1–3 that collimators having square holes with constant wall thickness can be obtained in the same fashion.

Figure 4:
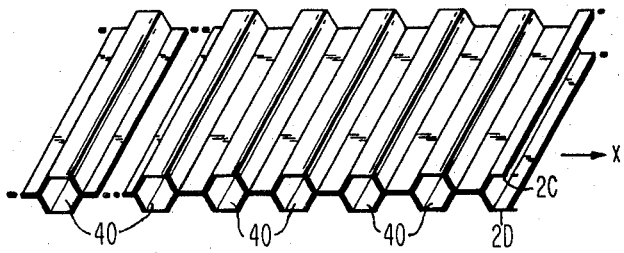
FIG. 4 is a perspective view of two profilated collimator strips adhered together to form hexagonal channels of equal wall thickness.

In FIG. 4 is illustrated that two profilated bands 2C and 2D, which are affixed together, form hexagonal radiation channels 40. The bands 2C and 2D have a trapezoidal profile. Their shapes are equal to the shapes of the band 2B illustrated in FIG. 3.

In FIG. 5 is illustrated that a preforming tool 50 may be included in front of the actual forming tools 4 and 6. This preforming tool 50 is a part of the first forming tool 4 and includes two wave-shaped teeth 52. Such a preforming tool 50 incorporated into the front portion of the first forming tool 4 eliminates the need for a separate corrugated forming tool and a separate preforming operation which is independent from the final forming of the band 2. Thus, in the operation of the apparatus of FIG. 6, the band 2 will first receive a wave-shaped profile and subsequently the final trapezoidal configuration.

In FIG. 6 is illustrated that shear blands 62 and 66 may be included in the apparatus. They are attached to the sides of the forming tool 4. These shearing blades 62 and 66 are provided to shear the profiled collimator strip to the finished width. In other words, these shear blades 62 and 66 remove overflow material on both sides of the finished collimator strip. They use the sides of the lower tool 6 as the other shearing edge. The shearing takes place on the down stroke of the upper tool 4, but only on that portion of the strip which has already been formed to its finished shape. In FIGS. 7 and 8 is illustrated that the second tool 6 supporting the flat die or plate 2 may be indexed in a circular motion. FIG. 7 is a plane view of the upper end face of the second forming tool 6. It will be noted that the teeth 12 are not parallel to each other. They are radially arranged such as to meet in a common (not shown). The various radial directions are denoted by 70. This is also true for the recesses 14 between the teeth 18. The first forming block 4 has the same configuration.

By moving the second forming block 6 in a circular motion underneath the first forming tool 4 tooth by tooth along the curved direction x2' and by carrying out a pressing or forming operation between each such step motion, profilated collimator strips are obtained which have radially converging teeth and recesses. After affixing together two layers of these profilated collimator strips, hexagonal radiation channels are obtained, the axes of which converge in one point. Several double layers can be arranged in a wedge form around a common axis of symmetry. Thus, forming tools designed according to FIGS. 7 and 8 enable the making of focused collimators, either of the full focus type or of the fan beam type.

Moving along the circular path x2' can be performed by a stepping motor, the rotation axis of which is located in the aforementioned common center of the radially arranged teeth 12.

In FIG. 9 is illustrated that the entire collimator strip can be produced with heated forming tools 4 and 6. Heating of the forming tools 4 and 6 will bring the band material into a flow condition, yet not into a melting condition. The combination of heat and pressure will result in a process wherein the band 2 is easily bent into the desired profile. According to FIG. 9, each forming tool 4 and 6 contains an electric heater 90 and 92, respectively. These heaters 90, 92 are electric coils wound through openings in the metal blocks 4 and 6. They are energized from an electric source (not shown). For the sake of clarity, only two windings are shown in each block 4 and 6. It is understood, however, that any suitable number of windings may be applied.

It should be mentioned, that heating can take place over the entire length of the tools 4 and 6, as illustrated in FIG. 9 with respect to the first tool 4, or only over a portion of the total length, as illustrated in FIG. 9 with respect to the second forming tool 6. It should also be noted that it may be sufficient to have a heater 90 or 92 merely in one of the forming tools 4 and 6, respectively. It will also be realized that any other type of suitable heater may be applied for heating the tools 4 and/or 6.

While the form of the method and apparatus for forming collimator strips herein described constitutes preferred embodiments of the invention, it is to be understood that the invention is not limited to these precise forms of assembly, and that a variety of changes may be made therein without departing from the scope of the invention.

What is claimed is:

1. An apparatus for forming a profiled collimator strip out of a band of a deformable material, comprising (a) a first forming tool having a first end face containing a first plurality of teeth along a first plane;

(b) a second forming tool having a second end face containing a second plurality of teeth along a second plane, whereby said second end face is arranged opposite and parallel to said first end face, and whereby said second plurality of teeth has the same pitch as and is staggered with respect to said first plurality of teeth;

(c) means for performing relative movements between said first and second tools parallel to said first and second planes when said first tool is in said retracted position, said relative movements being indexing step by step movements in the same direction; and (d) means for performing relative movements between said first and second tools, said relative movements comprising a closing movement whereby one of said tools moves from a retracted position linearly towards the other one of said tools until a forming position is reached, and said movements comprising an opening movement which is in opposite direction with respect to said closing movement.

2. The apparatus according to claim 1, wherein said first and second forming tools comprise metal blocks.

3. The apparatus according to claim 1, wherein the shape of said first and second plurality of teeth is trapezoidal, and wherein a first and second plurality of recesses having a trapezoidal shape are provided between said first and second plurality of teeth, respectively.

4. The apparatus according to claim 3, wherein in said forming position the distance between the top portion of each of said first teeth and the bottom portion of its adjacent second recess is smaller than the distance between a sidewall of each of said first teeth and a sidewall of its adjacent second recess.

5. The apparatus according to claim 1, wherein said first plurality of teeth is arranged along a first linear direction, and wherein said second plurality of teeth is arranged along a direction common to the first linear direction.

6. The apparatus according to claim 5, wherein end portions of said first and second teeth extend perpendicularly to said first linear direction and having width extending common to the first linear direction, respectively.

7. A method for forming a profiled collimator strip out of a band of deformable material, comprising the steps of (a) positioning a first portion of said band between a first forming tool having a first end face which contains a first pluraity of teeth arranged along a first linear direction, and a second forming tool having a second end face containing a second plurality of teeth arranged along a direction common to the first linear direction, said second plurality of teeth being arranged parallel and staggered with respect to said first plurality of teeth;

(b) moving said first forming tool from a retracted position towards said second forming tool into a forming position, thereby pressing said first portion of said band between said first and second forming tools, said first band portion thereby adopting a profile determined by the shape of said first and said second teeth;

(c) moving said first forming tool back to said retracted position; and (d) advancing said second die with said band perpendicularly to said first and second directions such that an adjacent second portion thereof is positioned between said first and second tools, wherein said advancing of said second die and band is performed in a step by step movement in the same direction by one tooth at a time.

8. The method according to claim 7, wherein said band is supported by one of said forming tools.

9. The method according to claim 7, wherein said first and second directions are horizontal directions, and wherein said first forming tool is moved vertically from said retracted position into said forming position, while said second forming tool is kept in a fixed portion, and wherein said second forming tool is advanced horizontally by at least one tooth while said first moving tool is in said retracted position having its teeth retracted from said band.

10. The method according to claim 7, wherein said advancing of said band comprises advancing three to five teeth at a time.

11. The method according to claim 7, wherein a preformed strip of material is positioned between said first and second forming tools.

12. The method according to claim 9, comprising the following steps in the order indicated:

(a) disengaging said first tool from said strip of material in a vertical direction;

(b) moving said second tool along said first tool in horizontal direction; and (c) pressing said first tool against said band of material, thereby forming an additional second portion of said band under pressure.

* * * * *